United States Patent [19]

Nishida

[11] Patent Number: 4,628,855

[45] Date of Patent: Dec. 16, 1986

[54] HULL NUMBER INDICATING APPARATUS

[75] Inventor: Hiroshi Nishida, Miki, Japan

[73] Assignee: Kawasaki Jukogyo Kabushiki Kaisha, Kobe, Japan

[21] Appl. No.: 689,660

[22] Filed: Jan. 8, 1985

[30] Foreign Application Priority Data

Jan. 18, 1984 [JP] Japan ..... 59-5522[U]

[51] Int. Cl.[4] ..... B63B 17/00

[52] U.S. Cl. ..... 114/364; 114/270; 114/357; 40/10 R; 40/625

[58] Field of Search ..... 114/364, 357, 270; 40/10 R, 591, 593, 16.2, 911, 625, 2 R; 280/809

[56] References Cited

U.S. PATENT DOCUMENTS

| | | | |
|---|---|---|---|
| 1,612,152 | 12/1926 | Ross | 40/625 |
| 3,174,239 | 3/1965 | Cramer | 40/16.2 |
| 3,826,220 | 7/1974 | Jacobson | 114/270 |
| 4,465,209 | 8/1984 | Wilder | 40/2 R |

FOREIGN PATENT DOCUMENTS

| | | | |
|---|---|---|---|
| 0161299 | 12/1979 | Japan | 40/16.2 |

*Primary Examiner*—Sherman D. Basinger
*Assistant Examiner*—Paul E. Salmon
*Attorney, Agent, or Firm*—Marshall, O'Toole, Gerstein, Murray & Bicknell

[57] ABSTRACT

This disclosure relates to apparatus and method for placing an identifying marking on a hull of a small boat. The boat includes a first part of the hull, and an opening is formed in the first part. A marking plate having a face side and a back side is made of a material which may be imprinted by deformation such as punching and hot stamping, and the plate is located closely adjacent the first part with at least a portion of the face side visible through said opening. The margin of the opening overlies the edge portion of the plate at least partially around the periphery of said plate, and a second part of said hull overlies at least a portion of the back side of the plate and is secured to the first part, thereby holding the plate in place.

2 Claims, 9 Drawing Figures

HULL NUMBER INDICATING APPARATUS

FIELD AND BACKGROUND OF THE INVENTION

This invention relates to small boats of the type wherein an operator stands or sits on the hull of the boat while guiding the boat using a handle pole.

Small boats of the foregoing type (also disclosed, for example, in Japanese Patent Provisional Pub. No. 49-58590) have become very popular as recreational boats. Generally, such a boat includes a hull which encloses a fuel tank, an engine, and a water jet propulsion unit driven by the engine. A floor is included in the hull and an operator stands on this floor. A vertically rotatable handle pole is supported on the hull and a handle lever to be held by the operator is attached to the rear end of the handle pole.

In a small boat constructed as described above, it is frequently required that a hull number be applied to the hull for production and quality control, for example. In one prior art construction, the hull is made of a material that cannot be deformed as by punching or hot stamping, and therefore a separate marking plate is attached to the hull only by adhesion. This construction has the disadvantage that the marking may be detached or altered intentionally. In another prior art construction where the hull is made of a deformable material, the marking is formed integrally with the hull. However, this construction has a disadvantage because occasionally a defective hull may be discarded, giving rise to complications for reviewing managers because of missing numbers.

BRIEF SUMMARY OF THE INVENTION

Apparatus in accordance with the present invention is designed to eliminate the foregoing defects, that is, to eliminate the risk of separation or intentional alteration of a marking plate, and also to avoid complications of the management review by preventing the occurrence of missing numbers.

In order to achieve the foregoing objectives, apparatus in accordance with this invention includes a recess or opening having a step on the margin, formed in the outer surface of the hull. A marking plate, made of a material printable by plastic deformation such as punching and hot stamping, on which the hull number is printed, is engaged in the step so as not to drop out of the opening.

BRIEF DESCRIPTION OF THE DRAWINGS

The foregoing will be better understood from the following detailed description taken in conjunction with the accompanying figures of the drawings, wherein.

DETAILED DESCRIPTION OF THE DRAWINGS

Figure 1:
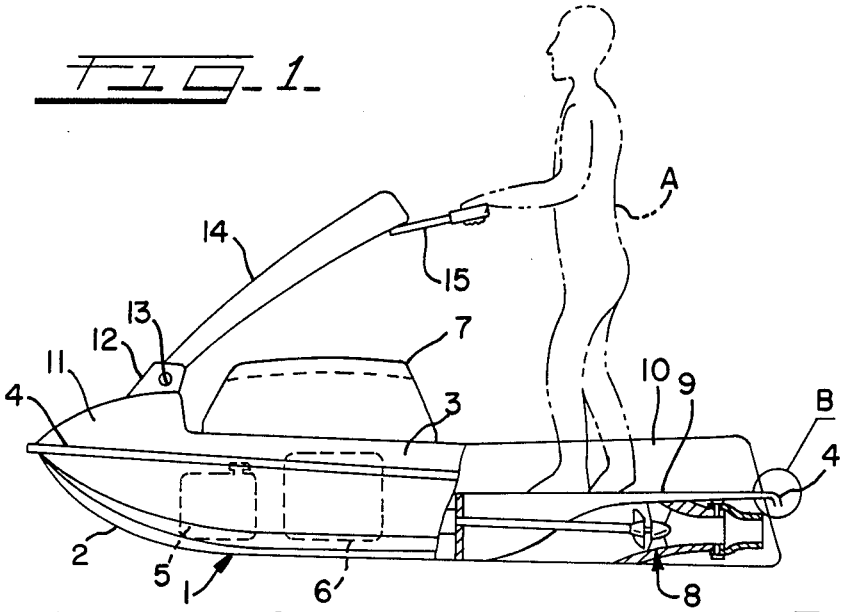
FIG. 1 is a partially cutaway side view showing a small boat to which this invention is applied.

FIG. 1 shows a small boat which glides on the water while being steered by an operator A in a standing or sitting position. The boat includes a lower hull 2 and an upper deck 3 which are assembled into a hull 1 by mutually adhering marginal flanges 4 that extend around the hull in a generally horizontal plane. A fuel tank 5 and an engine 6 are installed within the interior of the hull 1, and the top of the engine is covered by a detachable engine cover 7 that is connected to the upper deck 3. A water jet propulsion unit 8 driven by the engine 6 is mounted in the rear part of the hull 1 (also see Japanese Patent Provisional Pub. No. 49-58590). Numeral 9 denotes a floor which is integrally formed in the rear part of the deck 3 of the hull 1, and the operator A normally stands on this floor 9. At both sides of this floor, fins 10 project vertically and longitudinally. Numeral 11 indicates the bow, and a vertically rotatable handle pole 14 is supported by a pivot shaft 13 fastened to a handle pole bracket 12 which projects upwardly on the bow 11, and a handle lever 15 to be held by the operator A is attached to the rear end of the handle pole 14.

Figure 2:
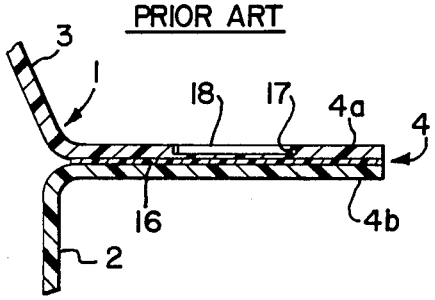
FIG. 2 PRIOR ART
FIG. 2 is a sectional view showing an example of a prior art hull number indicating device.
Figure 3:
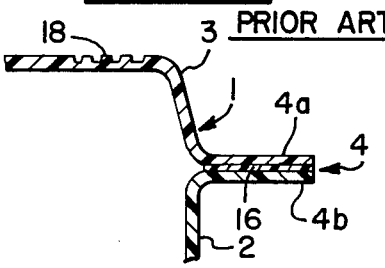
FIG. 3 PRIOR ART
FIG. 3 is a sectional view showing another example of a prior art device.

For a small boat constructed as described above, it may be required to indicate a hull number for production and quality control, for example, in a section of the marginal flanges 4. Conventional marking arrangements are shown in FIGS. 2 and 3, which are fragmentary enlargements of the portion enclosed by the circle B in FIG. 1. Marginal flanges 4*a* and 4*b* are secured by an adhesive 16 to combine the lower hull 2 with the deck 3 to form the complete hull 1. In FIG. 2, a recess 17 is formed in the upper surface of the marginal flange 4*a* of the deck 3, and a marking plate 18 is fitted in the recess 17 by an adhesive. In this method, which is used when the hull 1 is made of a material which cannot be marked by plastic deformation such as punching and hot stamping, a marking plate 18 made of ABS resin or the like which can be marked by plastic deformation is separately adhered in the recess. Accordingly, as shown in the drawing FIG. 2, since the marking plate 18 is secured in the recess 17 only by an adhesive, the plate 18 may be detached or altered intentionally.

By contrast, in the prior art method shown in FIG. 3, a marking 18 (such as the hull number) is integrally formed in the upper surface of the deck 3 by means of a die when forming the deck, and by this method the problems described in connection with FIG. 2 can be avoided. However, if the deck 3 is defectively formed in the manufacturing process and has to be discarded, the hull number of that deck will be missing from the list of numbers, which may give rise to complications in the management review and control.

The arrangements shown in FIGS. 4 to 9, in accordance with this invention, remedy the foregoing difficulties. The same reference numerals are used in these figures to indicate corresponding parts.

Figure 4:
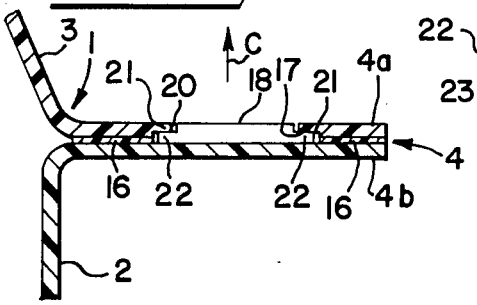
FIG. 4 is a sectional view showing a first embodiment of this invention.

In FIG. 4, numeral 1 is a hull which includes a lower hull 2 and a deck 3. The numeral 4 indicates peripheral marginal flanges which are formed on the periphery of the hull 2 and the deck 3, and these marginal flanges 4 are coupled together with an adhesive 16.

At a proper position on the marginal flange 4*a* of the deck 3, for example, adjacent the stern of the hull 1, and opening 20 is formed which opens or faces upwardly, that is, to the outside of the hull. A recess 17 is formed around the periphery of the opening 20 by undercutting the flange 4*a* around the margin of the opening 20, thereby forming a stepped part 21. A marking plate 18 made of a material printable by plastic deformation, such as ABS resin, is inserted into this recess 17. This marking plate 18 has a peripheral step part 22 which extends into the recess 17 below the stepped part 21, the part 22 extending outwardly from the lower side of the plate 18. A specified hull number (not shown) is marked on the face or upper surface of the plate 18, and this marking plate 18 is adhered and assembled in the opening 20 simultaneously with the assembly of the hull 2 and the deck 3.

Therefore, in this construction, since the marking plate 18 is retained by the step 21 which overlies the edge portion of the plate 18, the plate 18 cannot be movable in the direction C out of the opening 20, and it cannot be detached nor may it be easily altered. If altered, obvious signs of such alteration will remain, so that most troubles may be prevented. The flange 4*b*, of course, prevents removal of the plate 18 in the opposite direction. In addition, since the marking plate 18 is separately assembled when combining the deck 3 and the hull 2 after the deck 3 has been formed and approved, complication of management review due to a missing number cannot occur.

Figure 5:
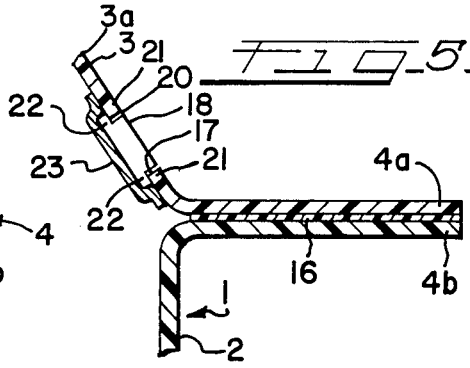
FIG. 5 is a sectional view showing a second embodiment.

FIG. 5 shows a second embodiment of the invention. In this case, a marking plate 18 is fitted to a rising side wall 3*a* of the deck 3 rather than on a marginal flange as in FIG. 4. That is, the marking plate 18 is fitted from the inside of the deck 3 to an opening 20 formed in the rising wall 3*a*, and a step part 22 of the plate 18 is located under a stepped part 21 which is formed by the margin of the opening 20. In this state, the marking plate 18 is held in place by an overlay 23 attached to the under or back side of the deck 3. The overlay 23 may be made of fibers impregnated in resin and fixed manually to the deck 3. In this embodiment, since the marking plate 18 is attached at a place other than between the marginal flanges 4, the adhesion of the marginal flanges 4, that is, the coupling of the hull 1, will be more secure.

Figure 6:
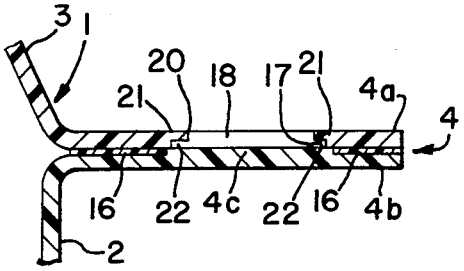
FIG. 6 is a sectional view showing a third embodiment.

FIG. 6 shows a third embodiment which is somewhat similar to the arrangement shown in FIG. 4. The marking plate 18 (FIG. 6) is preferably made of a thermoplastic resin, such as ABS resin, and is formed by pouring it into the recess 17 after the deck and the hull have been secured together. In this case, any complication which might occur when assembling the marking plate 18 simultaneously with securing the hull and deck parts as described in connection with FIG. 4 is eliminated, and a stronger adhesion between the parts is guaranteed by this pouring method. In this embodiment, moreover, the penetration of the adhesion 16 into the recess 17 when coupling the hull parts, especially into the space below the stepped part 21 and adjacent the edges 22, is prevented by a thickened part 4*c* of the hull flange 4*b*, the part 4*c* extending entirely across the underside of the opening 20. In other words, the thickened part 4*c* has a wider area than the range corresponding to the opening formed in the marginal flange 4*a*, and the adhesive 16 extends around the thickened part 4*c*.

Figure 7:
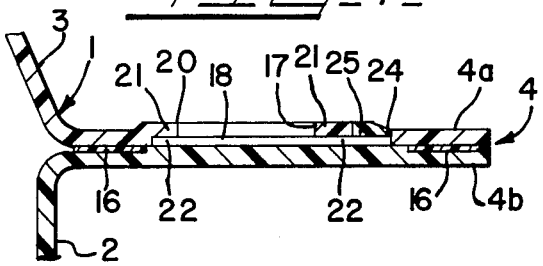
FIG. 7 is a sectional view showing a fourth embodiment.
Figure 8:
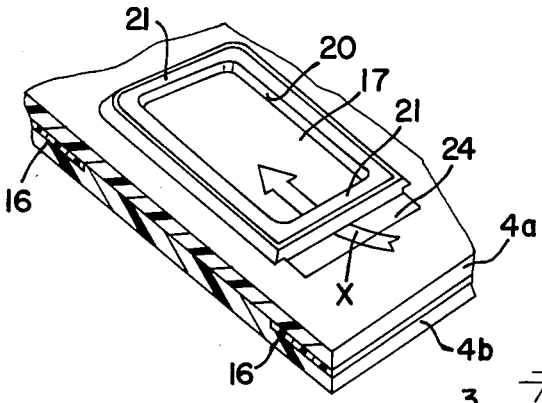
FIG. 8 is a perspective view of the embodiment shown in FIG. 7.
Figure 9:
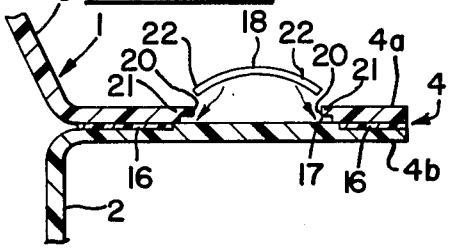
FIG. 9 is a sectional view showing a fifth embodiment.

FIGS. 7 and 8 show a fourth embodiment, in which the upper marginal flange 4*a* projects upwardly slightly around the opening 20, and a space or insertion hole 24 (FIG. 8) for inserting a marking plate 18 is formed in the upper flange 4*a* at one end of the opening 20 on the outside of the projecting portion. The marking plate 18 is assembled through the inserting hole 24 after adhering both marginal flanges 4*a* and 4*b*, the plate being inserted as indicated by the arrow X in FIG. 8, and thereafter the hole 24 is designed to be plugged with a sealing resin 25 as shown in FIG. 7. Or the marking plate 18 may be designed with an adhesive on its bottom side to be adhered to the flange 4*b*. Further, as is also true of the fifth embodiment shown in FIG. 9, the marking plate 18 is made of a resin or sheet metal which is formed so thinly as to be elastically deformable somewhat. The upper flange 4*a* has recesses 17 on only two opposite sides of the opening 20, and the other two sides are vertically straight. The plate 18 may be bent or deformed and thereby inserted into the recesses 17 after the hull 1 has been assembled. Furthermore, as in other embodiments except the one shown in FIG. 6, the hull number may be provided either before or after assembling the marking plate 18 in the opening. In the embodiment of FIG. 9, the marginal flanges 4*a* and 4*b* are constructed and assembled as shown in FIG. 6 and the marking plate is flexed in order to insert it. Once inserted, the plate would be very difficult to remove.

It will be apparent from the foregoing that a new and useful arrangement has been provided for placing a marking number on a small boat, wherein the risk of separation or intentional alteration of the marking plate may be reduced, and the occurrence of missing numbers is prevented. In each of the embodiments, an opening is formed in a part of the hull, a marking plate is positioned in the opening, a backing or support member engages and holds the back side of the marking plate, and the margin of the opening overlies the edge on the face side of the marking plate, thereby preventing removal of the plate. The marks or numbers are, of course, placed on the face side of the plate.

What is claimed is:

1. Apparatus for placing a marking on a hull of a small boat, comprising a first part of said hull, an opening formed in said first part, a marking plate having a face side and a back side and made of a material which may be imprinted by deformation such as punching and hot stamping, said plate being located closely adjacent said first part with at least a portion of said face side visible through said opening, the margin of said opening overlying the edge portion of said plate at least partially around the periphery of said plate, and a second part of said hull extending across at least a portion of said back side of said plate and secured to said first part, said hull comprising a deck and a hull, each of said deck and said hull including a marginal flange and said flanges being secured together, said first part and said second part being formed by said flanges.

2. Apparatus for placing a marking on a hull of a small boat, comprising a first part of said hull, an opening formed in said first part, a marking plate having a face side and a back side and made of a material which may be imprinted by deformation such as punching and hot stamping, said plate being located closely adjacent said first part with at least a portion of said face side visible through said opening, the margin of said opening overlying the edge portion of said plate at least partially around the periphery of said plate, and a second part of said hull extending across at least a portion of said back side of said plate and secured to said first part, said first part comprising a deck of said hull and said second part comprising a backing member which engages said plate and is secured to said hull.

* * * * *